United States Patent [19]

Evans et al.

[11] Patent Number: 4,624,878

[45] Date of Patent: Nov. 25, 1986

[54] WEATHERSTRIPPING PRODUCED BY TUFTING WITH FLATTENED KNUCKLES

[76] Inventors: Robert D. Evans, 44 Tubbs Springs Dr., Weston, Conn. 06883; Robert C. Blezard, 29 Homestead St., North Smithfield, R.I. 02895

[21] Appl. No.: 640,665

[22] Filed: Aug. 14, 1984 (Under 37 CFR 1.47)

[51] Int. Cl.[4] ..... D04H 11/00

[52] U.S. Cl. ..... 428/95; 156/72; 156/435; 428/85; 428/92; 428/96; 428/97

[58] Field of Search ..... 428/85, 92, 95, 96, 428/97; 156/72, 435

[56] References Cited

U.S. PATENT DOCUMENTS

| | | | |
|---|---|---|---|
| 2,994,929 | 8/1961 | Kessler | 428/92 |
| 3,175,256 | 3/1965 | Horton | 428/92 |
| 3,404,487 | 10/1968 | Johnson | 428/92 |
| 3,745,053 | 7/1973 | Johnson et al. | 428/92 |
| 3,836,421 | 9/1974 | Terry et al. | 428/92 |

*Primary Examiner*—Marion E. McCamish
*Attorney, Agent, or Firm*—Edward D. C. Bartlett

[57] ABSTRACT

A method of manufacturing weatherstripping includes tufting synthetic yarn into a primary backing fabric to form tufts on one side thereof and tuft "knuckles" on the other side. Then, the tuft knuckles are contacted with a heated surface of controlled temperature to deform and flatten them, the combined thickness of the primary backing and the tuft knuckles thus being reduced and the tufts being more securely attached to the primary backing. Preferably, there is relative motion between the tuft knuckles and the heated surface to effect a smearing of the tuft knuckles onto the primary backing. The flattened tuft knuckles may form a thin continuous strip adhering to the primary backing and locking the tufts thereto.

20 Claims, 16 Drawing Figures

WEATHERSTRIPPING PRODUCED BY TUFTING WITH FLATTENED KNUCKLES

FIELD OF THE INVENTION

This invention relates to weatherstripping, its method of manufacture by tufting, and tufting apparatus therefor.

BACKGROUND OF THE INVENTION

It has been suggested that the pile of pile weatherstripping might be formed by tufting, see for example U.S. Pat. No. 3,404,487 (Johnson). However, commercially pile weatherstripping is usually made by weaving, the rows of pile being obtained by slitting apart two interwoven base fabrics.

Pile weatherstripping is installed between the relative moving surfaces of doors or windows and their supporting frames to mitigate or eliminate infiltration of outside air, moisture, rain etc. Strips of weatherstripping are usually inserted in flanged or lipped grooves, and with such installations it is desirable for the base strip of the weatherstripping to be correctly dimensioned within appropriate tolerances in order to facilitate insertion into these lipped grooves.

Pile weatherstripping is known having one or more rows of pile fiber with or without central or side barrier fins. Examples of such styles of weatherstripping, their manufacture and use are disclosed in U.S. Pat. Nos. 3,836,421 (Terry et al); 2,994,929 (Kessler); 3,404,487 (Johnson); 3,745,053 (Johnson et al); and 3,175,256 (Horton).

SUMMARY OF THE INVENTION

Applicants believe that tufting offers a better route for more efficiently and economically producing weatherstripping commercially, preferably by a continuous process but also by a batch or interrupted process. However, Applicants have discovered that the base strip of weatherstripping produced by tufting can be too thick to be readily inserted in the lipped grooves or slots as currently employed in the windows and doors of buildings. This is due to the increased thickness of the base strip caused by the tuft "knuckles" formed by the stitches on the reverse side of the substrate, or primary backing, to that of the pile tufts. To accommodate the thickness of these tuft "knuckles" it would appear necessary either to use extra thin primary and secondary backings, so reducing the strength of the weatherstripping, and/or to use finer denier yarns in the tufting process, so detracting from the density of the pile.

It is an object of the present invention to produce tufted weatherstripping having tuft "knuckles" of reduced thickness.

It is another object of the present invention to improve the attachment of the tufts to the primary backing, i.e. to provide at least some degree of tuft locking independently of any secondary backing, or covering, coating or adhesive.

A feature by which these objects are attained is by applying a heated surface to deform and flatten the tuft "knuckles" onto and against the reverse side of the primary backing.

This feature provides the advantage of reducing the combined thickness of the primary backing and the tuft "knuckles", so enabling a wide choice of primary and secondary backing materials and of yarn deniers. It also provides the advantage that the flattened knuckles adhere to the reverse side of the primary backing so effecting tuft locking of the tufts.

Accordingly, therefore, there is provided by the present invention a method of manufacturing weatherstripping, including the steps of tufting synthetic yarn into a primary backing to form a row of tufts on one side of the primary backing backing and a row of tuft knuckles on the other side thereof. Then, contacting the tuft knuckles with a heated surface while controlling the temperature thereof to deform and flatten the tuft knuckles, whereby the combined thickness of the primary backing and the tuft knuckles is reduced and the tufts are more securely attached to the primary backing.

The yarn should be thermoplastic, or at least have a thermoplastic component, such as for example polypropylene, polyethylene, nylon, polyester etc. Polypropylene is preferred due to its properties and cost. Preferably textured multi-filament polypropylene yarn is employed, although a conjugate yarn having drawn filaments with a polypropylene core surrounded by a polyethylene sheath may be advantageous.

Preferably the primary backing is supported adjacent each side of the row of tufts while the tuft knuckles are being contacted with the heated surface. This may be accomplished by drawing the tufts through a groove or slot in a stationary support plate or accommodating the tufts in a groove in a roller.

There is preferably relative motion between the tuft knuckles and the heated surface to effect a smearing action whereby the heated and softened tuft knuckles are smeared onto and over the reverse side of the primary backing. Tension may be applied to the primary backing in a direction transverse to the direction of relative motion to aid this smearing action.

After the knuckles have been flattened, a secondary backing may be applied and then the product cut into individual strips of weatherstripping.

According to another aspect of the present invention there is provided apparatus for producing weatherstripping, comprising a tufter for tufting a row of tufts into a primary backing fabric, a heated member located downstream of the tufter for contacting the tuft knuckles formed on the reverse side of the primary backing, means for conveying the primary backing fabric through the tufter and past the heated member, and means for controlling the temperature of the heated member, whereby the tuft knuckles can be deformed and flattened.

There is also provided by another aspect of the present invention a weatherstripping product having a row of tufts tufted into a strip of primary backing fabric to form a row of pile fiber extending from one side of the strip and a row of connected tuft knuckles on the other side of said strip, the tuft knuckles being deformed and flattened into a ribbon adhering to the primary backing fabric.

Other objects, features and advantages of the present invention will become more fully apparent from the following detailed description of the preferred embodiment, the appended claims and the accompanying drawings.

DETAILED DESCRIPTION OF THE PREFERRED EMBODIMENTS

Figure 1:
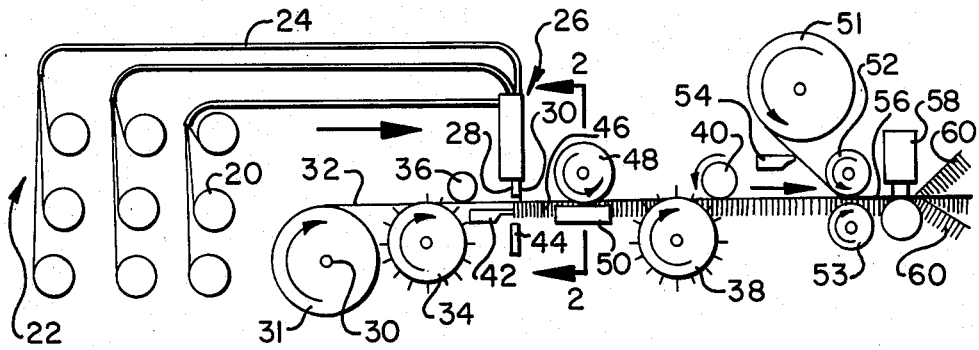
FIG. 1 is a diagrammatic side view of a tufting machine modified according to the present invention and producing weatherstripping.

FIG. 1 illustrates a tufting machine modified according to the present invention. Basically tufting machines are well known in the art, particularly in the carpet industry, and are designed in various widths up to fifteen feet. In performing the present invention, it is preferred to employ a tufting machine having a relatively narrow width, for example, between one and five feet. Bobbins 20 of yarn are supported in a creel, generally designated 22, and fed through overhead plastic tubes 24 to the tufter 26 having a vertically reciprocating needle bar 28 carrying a row of needles 30. A roll 31 of primary backing fabric is rotatably supported on a spindle 30 positioned between the creel 22 and tufter 26. Primary backing 32 is drawn from the supply 31 by a driven spiked roller 34, the primary backing 32 then passing below an idle roller 36, past and below the needle bar 28, and is further drawn forward by another spiked driven roller 38 having an associated upper idle roller 40. Below the needle bar 28, and the primary backing 32, is a needle plate 42 having slots therein through which the needles 30 penetrate when reciprocated. Below and adjacent the downstream edge of the needle plate 42 is a looper and cutter mechanism 44. As the needles 30 are reciprocated through the primary backing 32, loopers in the mechanism 44 engage the loops of yarn so formed and cutters in the mechanism 44 cut these loops to form cut pile. If it is desired to form looped pile, then these cutters and loopers are inactivated and another set of loopers employed. The details of the foregoing parts and mechanisms, and their operation, are well known in the tufting art and need not be described further.

When rows of tufts are formed in this way in the primary backing 32, the tufts extend downwardly below the primary backing as indicated at 46, and "knuckles", i.e. short stitches, are formed on the upper surface of the primary backing 32 between consecutive tufts. In order to treat these "knuckles" in accordance with the present invention, there is located a short distance downstream from the tufter 26, for example, 1 to 3 feet downstream, a driven roll 48 which engages and presses downwardly on the tuft "knuckles", and cooperates with a plate 50 immediately below the primary backing 32 to deform and flatten these "knuckles".

Downstream of the rollers 38, 40, a supply roll 51 of secondary backing is rotatably mounted above the primary backing fabric 32, the secondary backing being drawn downwardly from the supply under a driven roller 52 past an adhesive applicator 54. The adhesive coated secondary backing 56 is laminated to the tufted primary backing 32 by the roller 52. To achieve this the roller 52 forms a nip with a grooved support roller 53, the secondary and primary backings 56, 32 being squeezed together as they pass through this nip. The rows of tufts 46 are accommodated in annular grooves in the roller 53 to prevent the tufts being flattened or damaged. Downstream from the rollers 52, 53, and extending transversely across the secondary backing 56, is an ultrasonic cutter 58 having a plurality of horns spaced apart to cut the tufted and backed fabric into a series of strips 60. These strips 60 are then wound individually onto take-up bobbins to form bobbins of weatherstripping.

Figure 2:
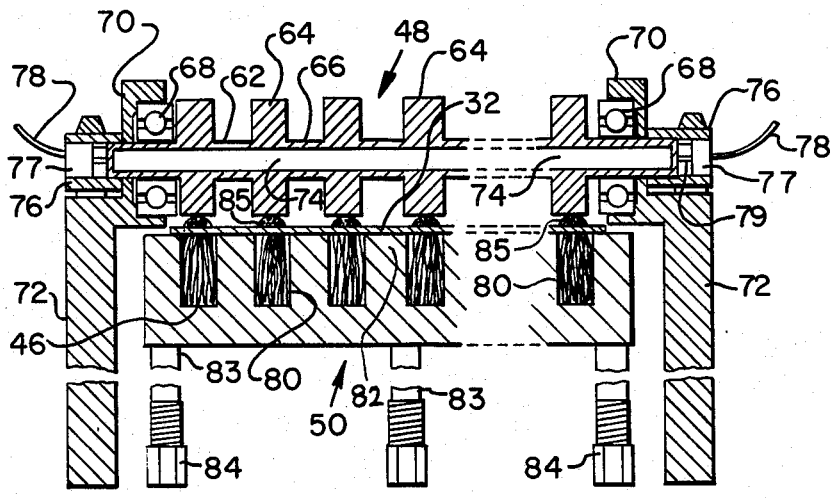
FIG. 2 is a section, on a larger scale, on the line 2—2 of FIG. 1.

FIG. 2 shows in greater detail a cross section on the line 2—2 of FIG. 1 of the "knuckle" deforming roller 48 and the support plate 50. The roller 48 has a central shaft 62 carrying integral disk-like wheels 64 spaced apart axially along the length of the shaft 62, so forming annular spaces 66. The ends of the shaft 62 are rotatably mounted in bearings 68 secured in housings 70 formed on side support frame members 72. The shaft 62 has a central bore through which is inserted from opposite ends two cartridge heaters 74 which together extend the full length of the bore. End caps 76, non-rotatably mounted over the ends of the shaft 62, contain terminal and brush blocks 77, each of which carries a pair of spring loaded carbon brushes 79 which are resiliently urged into electrical contact with annular slip rings insulated in the end surfaces of the shaft 62. The electrical power is supplied to the cartridge heaters 74 via electric leads 78, the brushes 79, and the slip rings. The support plate 50 has a series of slots or grooves 80 formed in, and extending downwardly from its upper surface, to accommodate rows of tufts 46 extending downwardly from the primary backing 32. The grooves 80 are located under and in alignment with the disks 64 of the roller 48. Between the grooves 80 the plate 50 has support ribs 82, each rib 82 contacting and supporting the primary blacking 32 between a pair of adjacent rows of tufts 46, with the disks 64 contacting the "knuckles" of the rows of tufts between pairs of adjacent ribs 82. The plate 50 is supported on a series of legs 83 which have bottom caps 84 screw-threaded thereon for adjusting the height of the table 50. The clearance between the disks 64 and the primary backing 32, together with the size of the groups 85 of knuckles, are shown exaggerated for clarity.

Figure 3:
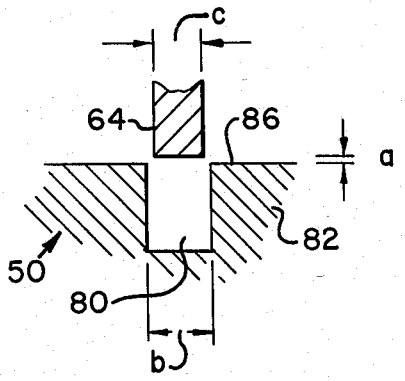
FIG. 3 is a fragmentary section showing more clearly a detail of FIG. 2.

FIG. 3 is a fragmentary view, without the primary backing present, showing one of the disks 64 in alignment with one of the grooves 80. The adjustable caps 84 (FIG. 2) should be adjusted so that the clearance a , between the lower surface of the disk 64 and the support surface 86 of the plate 50, is a few thousandths of an inch greater than the thickness of the primary backing 32. For example, with a primary backing having a thickness of 15 thousandths of an inch, the clearance a could be set at 17 thousandths of an inch. The width b of the grooves 80 is chosen so that the groups of tufts 46 are a comfortable sliding fit therethrough. For example, if each group of tufts 46 contains three rows of tufts formed from textured multi-filament one thousand denier yarn, then the width b would be about 0.115 inches. The width c of the disk 64 is preferably chosen to be slightly less than the width of a group 85 of knuckles, and is so preferably less than the width b of the groove 80. For example, with a group 85 of three knuckles having a width of 0.075 inches, the width of the disk 64 would be 0.070 inches.

Figure 4:
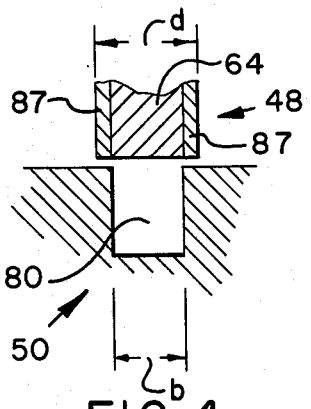
FIG. 4 is a view similar to FIG. 3 illustrating a modification.

FIG. 4 is similar to FIG. 3, but showing a modification of the roller 48. In this modification, each disk 64 has secured to each of its outer upright surfaces an annular disk 87 of heat insulating material, for example, asbestos. Each annulus 87 has the same outer diameter as the disk 64 and increases the width d of the composite disk 64, 87 so that it is greater than the width b of the grooves 80.

Figure 5:
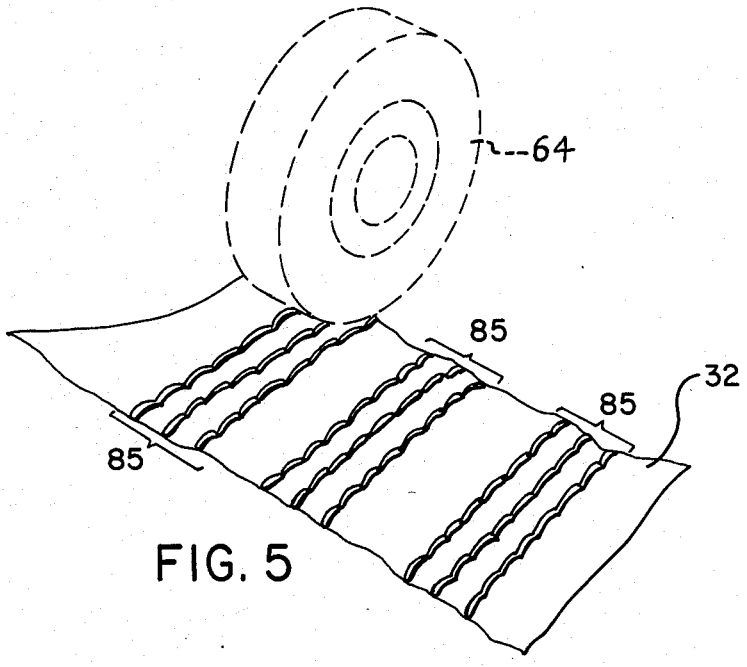
FIG. 5 is a perspective view from above of a portion of primary backing having groups of rows of tufts inserted downwardly therethrough and showing the "knuckles" of the tufts.

FIG. 5 shows in perspective view a portion of the secondary backing 32 when between the tufter 26 and the roller 48. Extending along the primary backing 32 are a series of groups 85 of three rows of knuckles. In this case, each group of tufts 46 is comprised of three rows of tufts, needles 30 of the needle bar 28 having been omitted between adjacent groups of tufts 46. By omitting or adding needles 30, each group of tufts 46 can be arranged to have less or more than three rows of tufts therein. Shown in phantom lines is a disk 64 engaging the left hand group 85 of knuckles which will later be incorporated in a single strip of weatherstripping.

Figure 6:
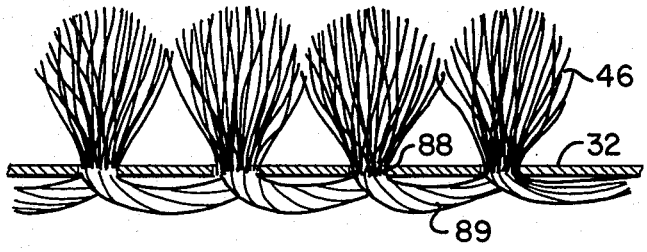
FIG. 6 is a diagrammatic section of a row of tufts before having been treated according to the present invention and before a secondary backing has been applied.

FIG. 6 illustrates a longitudinal section through a single row of tufts after the product has been inverted from the position shown in FIG. 5. Individual tufts 46 of filaments extend upwardly in bushy fashion from holes 88, formed by a needle 30, in the primary backing 32. Consecutive tufts along the length of the row are connected below the primary backing 32 by loops or stitches 89. Each such stitch 89 constitutes a knuckle.

In operation, the stitch of the tufter 26 and the grouping of the needles 30 are chosen for the weatherstripping product to be produced. The primary backing 32 is fed through the apparatus at a constant linear speed by the spiked drive rollers 34 and 38. The secondary backing 56 is fed onto the upper surface of the primary backing 32 at the same linear rate by the driven roller 52. The rollers 36 and 40 idle by contact with the upper surface of the secondary backing 32. Sufficient distance is left between the roller 52 and the ultrasonic slitter 58 to allow the adhesive layer between the primary and secondary backings to set, and sufficient distance is left between the cutter 58 and the take-up bobbins (not shown) to allow the cut edges of the individual strip 60 to solidify. The disks 64 of the roller 48 are heated by the cartridge heaters 74 to a temperature about the softening point or approaching the melting point of the fiber of the tufts 46. If the temperature of the roller 48 is at the melting point of the fiber, then the roller 48 should be rotated at a peripheral speed equal to that of the linear speed of the primary backing 32, the roller 48 being rotated in the direction of the arrow in FIG. 1. Under these conditions, preferably the primary backing 32 should be made of a material with a higher melting point than that of the fibers of the tufts 46. For example, if the tufts 46 are made from continuous filament polypropylene, then the primary backing 32 could be of polyester. However, if the roller 48 is rotated at a different peripheral speed from the linear speed of advancement of the primary backing 32, then the roller 48 can be heated to a temperature below the melting point of the fiber of the tufts 46, for example 30° F. below. For example, the peripheral speed of the roller 48 could be 5% to 20% less than the speed of the primary backing, or could be greater, for example, 10% greater. By having a relative speed between the periphery of the heated roller 48 and the advancing primary backing 32, a smearing action occurs which deforms and moulds the material of the knuckles even though the temperature of the roller 48 is below the melting point of this material. Although the disks 64 of the roller 48 effect a downward pressure upon groups of knuckles 85, due to the small clearance between the disks 64 and the primary backing 32, the primary backing 32 is adequately supported by the surface 86 of the ribs 82 of the plate 50, so enabling the knuckles to produce a reaction pressure against the disks 64. The slots 80 prevent the groups of tufts 46 from being affected or crushed by the roller 48. When the tufts 46 are formed from polypropylene filaments, and the temperature of the roller 48 is set below the melting point of polypropylene, for example, at 310° F., then a polypropylene primary backing 32 can be used, such as Typar (Trademark) made by E. I. duPont de Nemours and Co. and which has preferably been heat treated.

By having the width c of the disk 64 just less than the width of each group 85 of knuckles, the effect of the heat of the roller 48 on the primary backing 32 is minimised, this being of particular importance when the temperature of the roller 48 approaches, or is even above, the melting point of the material of the primary backing 32.

The modification of FIG. 4 enables the softened groups 85 of knuckles 89 to be deformed uniformly sideways by having an overall width d greater than that of each group 85 and of the slot b. Although the heat insulating material annuli 87 directly overlap the primary backing 32 to a certain extent, conduction of heat by the annuli 87 is sufficiently limited to avoid adversely affecting or melting the primary backing 32.

Figure 7:
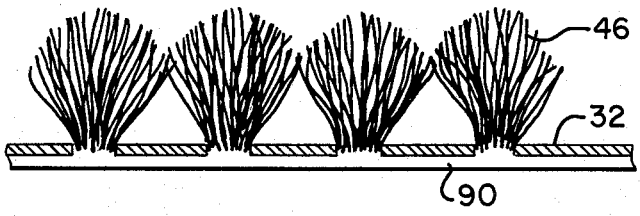
FIG. 7 is a view similar to FIG. 6 after the "knuckles" of the tufts have been treated according to the present invention.
Figure 8:
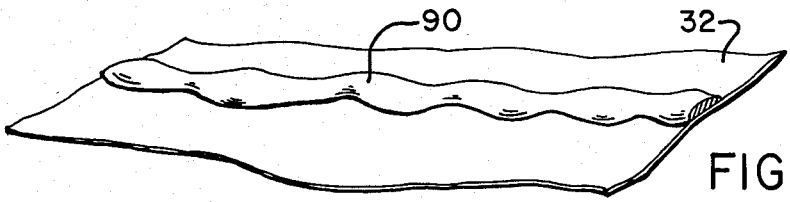
FIG. 8 is an underneath view of the treated "knuckles" of the row of tufts of FIG. 7.

FIG. 7 is a view similar to FIG. 6 but after the knuckles have been processed between the roller 48 and the plate 50. The knuckles, or stitches, have now been flattened and spread into a thin layer 90 which adheres against the primary backing 32. In fact, the layer 90 is bonded to the primary backing 32. The layer 90 is only a few thousandths of an inch thick, and the thickness of the primary backing 32 with the layer 90 attached thereto is substantially less than the thickness of the primary backing 32 with the knuckles 89 (see FIG. 6) protruding therefrom. FIG. 8 shows an underneath view of the primary backing 32 of FIG. 7, illustrating the continuous thin strip 90 extending therealong.

Figure 9:
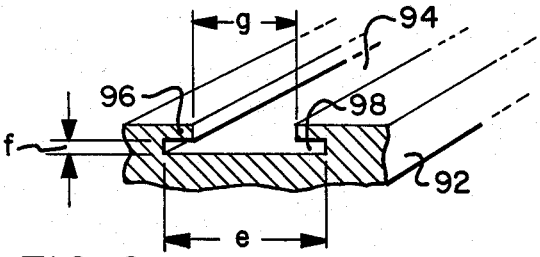
FIG. 9 is a fragmentary perspective view illustrating a slot in a door or window into which weatherstripping is to be inserted.

FIG. 9 illustrates a fragment of a metal window frame 92 having a slot 94 therein for accommodating weatherstripping. The slot 94 has a wider base portion 98 access to which is confined by two inwardly projecting lips 96. Typical dimensions of the groove 94 are: e groove width at base 0.31 inches (7.9 mm), f lip height 0.05 inches (1.3 mm), and g lip opening 0.18 inches (4.6 mm).

Figure 10:
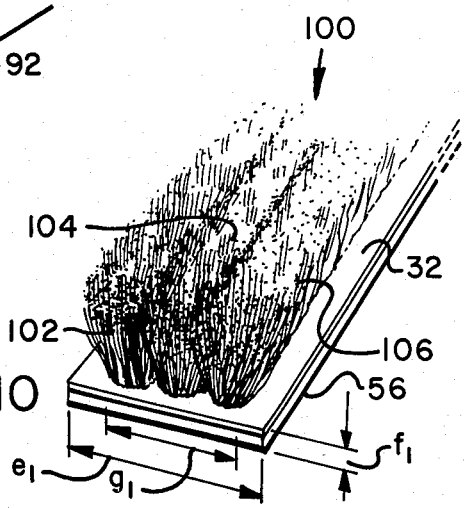
FIG. 10 illustrates in perspective view a length of finished weatherstripping.

FIG. 10 illustrates a length of finished weatherstripping 100 made according to the above process and having a bushy pile formed by three rows 102, 104, 106 of tufts secured in a strip of primary backing 32 to which is adhered secondary backing 56. Typical dimensions for this weatherstripping are: $e_1$ backing width 0.27 inches (6.9 mm), $f_1$ backing thickness 0.035 inches (0.9 mm), $g_1$ width of pile adjacent backing 0.16 inches (4 mm), and pile height 0.32 inches (8 mm). This weatherstripping is mounted to the window 92 of FIG. 9 by sliding or snapping the backing strip 32, 56 into the base 98 of the groove 94 below the projections 96. In order for the assembly of the weatherstripping to the window to be accomplished readily and without damage to the weatherstripping, there needs to be certain minimum tolerances between the dimensions of the base strip 32, 56 and the dimensions of the base 98 of the groove. Typically, the thickness $f_1$ of the base strip 22, 56 should be at least 0.015 inches less than the lip height f of the base 98 of the groove, and the backing width $e_1$ should be about 0.040 inches less than the groove width d. A typical primary backing, for example, Typar, has a thickness of about 0.014 inches, and may be as thick as 0.017 inches. A non-orientated polypropylene film for the secondary backing has a thickness between 0.010 to 0.015 inches, and a suitable adhesive (such as a hot melt adhesive) for laminating the secondary backing to the primary backing results in an adhesive layer having a thickness of about 0.003 to 0.004 inches. When the knuckles of tufted weatherstripping are flattened in accordance with the present invention, they result in the thin strip 90 which has a thickness of between 0.002 and 0.005 inches. Thus, weatherstripping made in accordance with the invention and using primary and secondary backing fabrics as indicated, would result in the overall backing thickness falling within the range 0.029 to 0.041 inches. As previously mentioned, flattening the knuckles of the tufts in accordance with the invention, also effects a strong tuft locking of the tufts to the primary backing. Consequently, the secondary backing does not need to perform a tuft locking function, and so the laminate strength between the secondary and primary backings can be reduced without adversely affecting the durability of the weatherstripping. This enables low temperature adhesives to be employed, and also a thinner layer of adhesive. Taking advantage of the thinner adhesive layer, and employing secondary backing material at the lower end of the thickness range, for example, non-orientated polypropylene film having a 0.010 inch thickness, it becomes possible to produce tufted weatherstripping in which the overall thickness of the backing is in the range of 0.029 to 0.035 inches.

In order to obtain the thinnest thickness of the knuckle strip 90, it is possible to grip the longitudinal edges of the primary backing 32, at least in the vicinity of the heated roller 48 and the support table 50, to stretch the primary backing 32 sideways to generate sufficient lateral tension in the primary backing to minimise any deflection of the primary backing into the grooves 80 by the disks 64. Conventional tenter frame arrangements and mechanisms can be used to accomplish this and also to transversely locate and guide the tufted primary backing.

Figure 11:
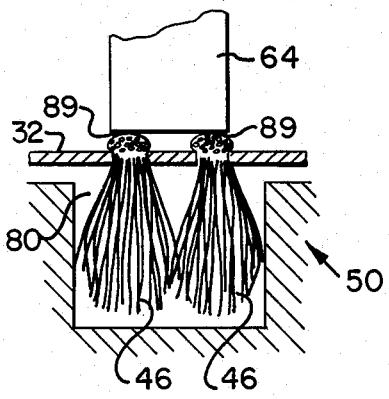
FIG. 11 is a fragmentary section of a detail similar to FIGS. 3 and 4, showing a double row of tufts being treated according to the invention.

FIG. 11 illustrates the flattening or deforming of the knuckles 89 by one of the disks 64 of weatherstripping being formed with tufted pile having two rows of tufts 46. Such weatherstripping may have a less overall pile width than that shown in FIG. 10; however, the knuckle flattening process of the present invention, enables the tufts to be made from heavier denier yarn, for example, 2,000 denier multi-filament polypropylene yarn, and still produce a product that has an overall base strip thickness that falls within the tolerances given above. By the use of such heavier denier yarn, the overall width, and denier, of the two rows of tufts in FIG. 11 could be made equal to or greater than the pile in FIG. 10. The significance of this becomes more apparent when it is realised that, when tufting with a 1,000 denier yarn, the thickness of the knuckles formed is in the range of 0.020 to 0.030 inches, and with 2,000 denier yarn in the range of 0.030 to 0.040 inches, even though the diameters of such yarns are substantially less than these dimensions in the tensionsed condition before being tufted.

Figure 12:
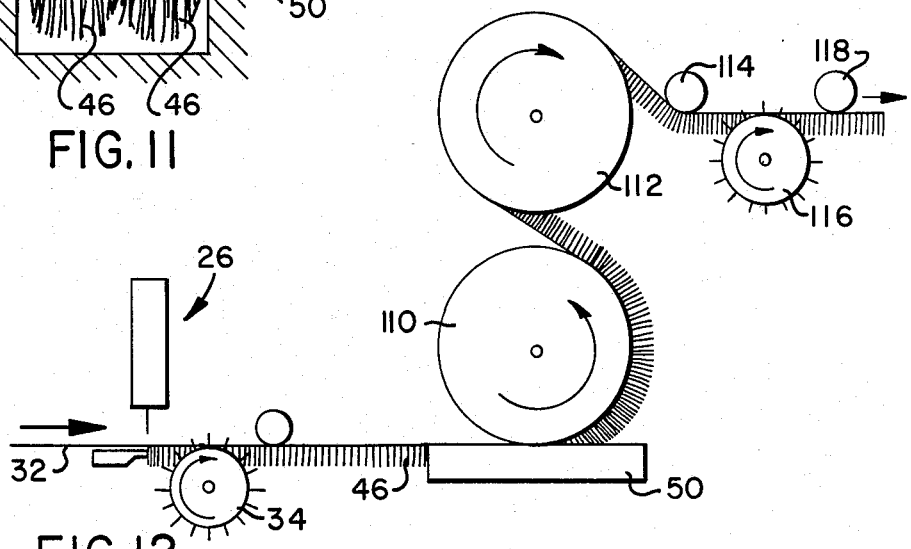
FIG. 12 is another embodiment of the invention showing a tufting machine provided with "knuckle" deforming equipment.

FIG. 12 illustrates a modification to the apparatus of FIG. 1. The roller 110 for deforming the knuckles in conjunction with the support plate 50 is similar to the roller 48 in FIGS. 1 and 2 except that it has a substantially larger diameter, for example, three feet (about 1 meter), and the tufted primary backing 32 is caused to wrap around in contact with this roller 110 approximately 180 degrees. Above the roller 110, and in spaced relation thereto, is another large diameter roller 112 having a series of parallel grooves therein around its circumference, these grooves being similarly dimensioned and spaced as the grooves 80 in the support plate 50 (see FIG. 2). The peripheral grooves in the roller 112 accommodate the rows of tufted pile to prevent crushing or deformation thereof. The tufted primary backing 32 leaves the roller 112 after having subscribed an arc of over 180 degrees, and moves downwardly below and in contact with an idling roller 114, and is then drawn horizontally forwardly by a driven spiked roller 116 having an associated idler roller 118. Thereafter, the tufted primary backing 32 has the secondary backing laminated thereto, and then follows a slitting operation to produce the individual weatherstrips, as previously described in relation to FIG. 1. With this modification, the knuckles of the tufts are in contact with the disk surfaces of the grooved roller 110 for a substantially greater distance and a substantially greater time. This enables lower temperatures to be used, particularly when primary backings are employed which have a rather low melting point. For example, when using non-woven polypropylene primary backing and multifilament polypropylene pile yarn, the roller 110 can be controlled at a temperature in the range 270° to 300° F. while being rotated at a peripheral speed of 5% slower than the linear speed of advancement of the primary backing by the driven spiked rolls 34, 116. The roller 112 preferably is left to idle, but may be driven at the same peripheral speed as the spiked rollers 34, 116.

Figure 13:
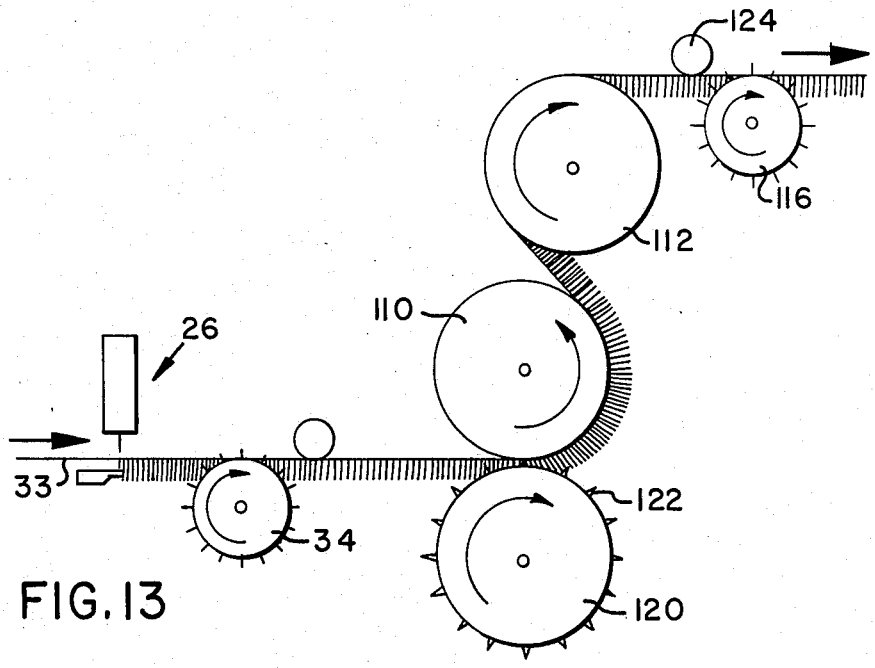
FIG. 13 is a further embodiment of the invention showing a tufting machine provided with a modified "knuckle" deforming arrangement.
Figure 14:
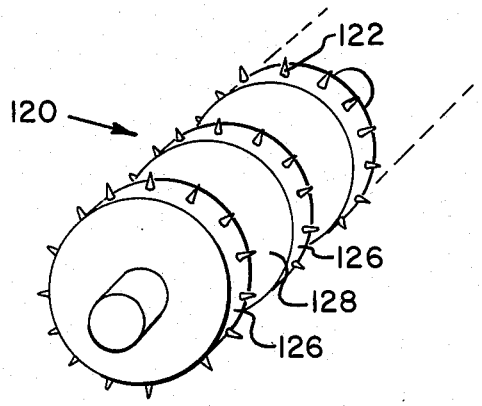
FIG. 14 illustrates in perspective view the lower roller of the "knuckle" deforming arrangement of FIG. 13.

FIG. 13 illustrates another modification of the apparatus of FIG. 1. The modification of FIG. 13 is the same as that of FIG. 12, except that the support plate 50 is replaced by a large driven roller 120 having grooves therein to accommodate the rows of tufts and also having spikes 122 peripherally protruding from the roller to engage the secondary backing 32. Also, the upper roller 112 is displaced slightly to the right of the heated roller 110 and the tufted primary backing 132 is drawn horizon tally from the roller 112 by the driven spiked roller 116. In this case, the idler roll 124 is located just before the spiked roller 116. FIG. 14 illustrates in perspective view a portion of the length of the roller 120 showing the annular grooves 128, similarly dimensioned and spaced apart as the grooves 80 in FIG. 2, to accommodate the rows of tufted pile and prevent them from being deformed and crushed. These grooves 128 are defined between disks 126 the periphery of which support the primary backing 32. The spikes 122 for drivingly engaging through the primary backing 32 extend radially outwardly from the periphery of the disks 126. The roller 120 is not heated, but is rotated at a peripheral speed equal to that of the driven spiked rollers 34, 116 and so of the linear speed of the primary backing 32. This embodiment is particularly advantageous when it is desired to maintain the roller 110 at lower temperatures, for example 225° F. (107° C.), and rotate the roller 110 at a peripheral speed which is substantially different from that of the linear speed of the primary backing 32. Substantial smearing action of the disk surfaces of the roller 110 on the tuft knuckles being deformed can be obtained without adversely affecting the operation of the tufter 26. It will be appreciated that other than the spikes 122, the roller 112 is configured similarly to the roller 120.

Figure 15:
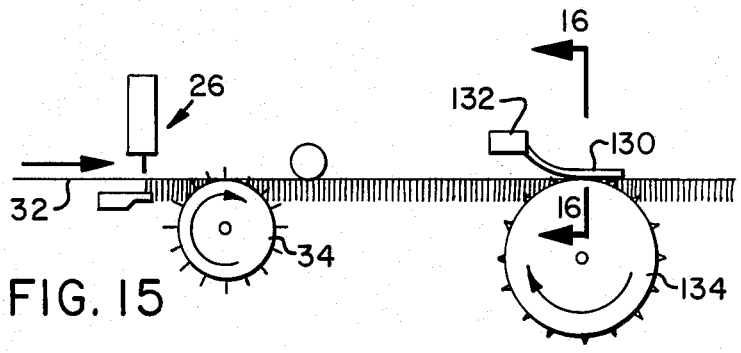
FIG. 15 illustrates in side view a tufting machine having yet a further modified "knuckle" deforming arrangement according to the invention.

FIG. 15 illustrates a further modification of the apparatus of FIG. 1. The heated roller 48 has been replaced by a plurality of heated fingers 130 mounted on a bar 132 and spaced apart transversely across the primary backing 32. The bar 132 is adjustably pivotal about its longitudinal axis to raise and lower the fingers 130 away from and toward the primary backing fabric 32, and to adjust the pressure of the fingers 130 against the tuft knuckles extending above the primary backing. Also, the support plate 50 is replaced by a driven grooved and spiked roller 134, similar to the roller 120 of FIGS. 13 and 14 but of smaller diameter.

Figure 16:
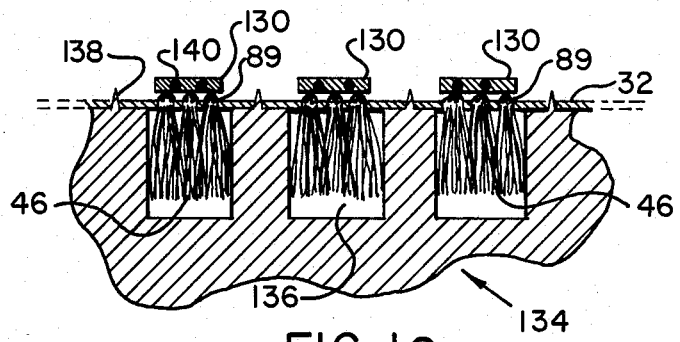
FIG. 16 is a fragmentary section on the line 16—16 of FIG. 15.

FIG. 16 is a cross section on the line 16—16 of FIG. 15 and shows the thin plate-like fingers 130 engaging the knuckles 89 of the rows of tufted pile 46. The rows of tufted pile 46 are accommodated in annular peripheral grooves 136 in the roller 134, and the outer peripheral surface of the roller 134 supports the primary backing 32 and also carries protruding spikes 138 which engage through the primary backing. The fingers 130 have implanted therein heating elements 140 . The width of the fingers 130 is slightly less than the width occupied by the groups of knuckles of the tufted pile 46 of an individual weatherstripping section. In operation, the fingers 130 are controlled at the desired temperature and the bar 132 adjusted to cause the fingers 130 to engage the knuckles 89 at the desired pressure. The roller 134 is rotatably driven at a peripheral speed equal to that of the spiked roller 34 to positively feed the primary backing 32 past the fingers 130. The fingers 130 have a degree of resiliency to accommodate the reducing height of the knuckles 89 as the latter are deformed and flattened. This embodiment is particularly designed to cause the knuckles 89 to melt and flow to form a thin ribbon-like layer of material (see 90, FIG. 8) rather than accomplish this by the effect of pressure. It is possible with this embodiment to control the temperature of the fingers 130 at or around the melting point of the fibers of the knuckles 89. For example, when the tufted pile 46 is formed from multi-filament polypropylene, the fingers 130 could be heated to a temperature in the range of 325° to 350° F. (163° to 177° C.), and the bar 132 set for the fingers 130 to contact the knuckles 89 with a light pressure. The smearing action created by the heated knuckles being drawn past the stationary fingers 130 completes the deformation of the knuckles 89 and the spreading of the material thereof into a very thin uniform layer.

Mechanism may be incorporated to pivot the bar 132 automatically upon stopping of the tufter 26 to lift the fingers 130 out of engagement with the knuckles 89. Similarly, in the embodiment of FIG. 1, mechanism may be incorporated to raise the heated roller 48 out of engagement with the knuckles on the primary backing 32 in response to stopping of the tufter 26.

Examples to illustrate how the method of the present invention can be performed are given below:

EXAMPLE 1

A tufting machine similar to FIG. 1 and having a needle bar 12 inches wide fitted with pairs of needles with center to center needle distances of 0.0625 inches, and in which the pairs of needles are arranged on 0.187 inch centers, with the loopers and cutting bars arranged to cut pile 0.20 inches high, should be used to tuft two ends per needle of a 1050 denier 70 filament UV stabilized black polypropylene yarn, manufactured by the Phillips Fibers Co. of Greenville, S.C. and which contains a silicone additive to give enhanced water repellency, into a 14 inch wide Typar (trademark) primary backing weighing 4.2 ounces per square yard. The tufting machine should be operated at 800 stitches per minute with 16 stitches per inch and a production rate of 50 inches per minute. The tufting machine contains a guiding mechanism to feed flat primary backing into the tufting area on a supporting table. Immediately after tufting, the tufted fabric is supported on the slotted support plate with slots 0.135 inches wide and 0.3 inches deep aligned with each pair of needles. About 18 inches from the turfing the electrically heated driven roll is mounted above the support plate. The roll consists of a series of centrally supported disks, one for each pair of tuft knuckle rows with each disk being 0.120 inches wide. The roll is driven at a peripheral speed of 40 inches per minute in the direction of the moving fabric and is heated to about 310° F. The heated roll is adjusted so that there is a clearance of 0.003 inches between the disks and the primary backing. Through this area the fabric is moved forward on the support plate and its movement transversely is prevented by a pin tenter arrangement. About 18 inches from the heated roller, the seconday backing applying roller is provided which has a peripheral speed of 50 inches per minute. This roller pressure laminates a coated fabric to which has been applied 0.005 inches of a hot melt adhesive. The coated fabric consists of a needled polypropylene non-woven which has been extrusion coated with 0.006 inches of polypropylene resin. After lamination the fabric should be cooled by passing it unsupported through an air cooled chamber and is then slit into 64 individual linear weatherstrips each approximately 0.187 inches wide by a series of ultrasonic slitters, and finally packaged. The linear weatherstrip so produced contains a total fiber denier of 67,000 per row inch and will readily fit into a slot with a lip opening of 0.125 inches, a slot width of 0.210 inches and a slot height of 0.05 inches. The pile fibers will be firmly locked into place and very resistant to removal.

EXAMPLE 2

A tufting machine similar to that of Example 1 is used, except that the needles should be arranged in groups of three with the groups arranged on 0.27 inch centers and with the slots in the support plate arranged on 0.27 inch centers and being 0.15 inches wide and 0.30 inches deep. The disks of the heated roll should be 0.14 inches wide. the other steps are identical with those of Example 1 except that the fabric produced is slit into lengths of weatherstripping each 0.27 inches wide. A total of 44 weatherstrips is produced. These weatherstrips each contain three rows of pile, each pile row containing a total of 67,000 fiber denier. The weatherstrips so produced will fit readily into slots having lip openings of 0.18 inches, groove widths of 0.31 inches and groove heights of 0.05 inches.

EXAMPLE 3

A tufting machine similar to that of Example 1 should be used but with the needles arranged in pairs with center to center needle distances of 0.125 inches and with the needle pairs arranged on 0.27 inch centers. The pile yarn is a 2500/160 conjugate sheath and core yarn having a polyethylene sheath and a polypropylene core and is UV stabilized. Each needle would contain one pile yarn. The other processing conditions are similar to Example 1, except that the heated roll is controlled to 265° F. The product is slit to give 44 weatherstrips each 0.27 inches inches wide. Each weatherstrip contains 2 rows of pile, and each row contains a total fiber denier of 80,000 per linear inch.

It will be appreciated from the above, that the present invention enables pile weatherstripping to be made by tufting with the achievement of superior tuft locking and a base strip having an overall thickness that is compatible with the normal dimensions conventionally employed in the lipped slots of windows and doors. It will also be appreciated, that the present invention enables weatherstripping to be made by tufting as a continuous process.

The above described embodiments, of course, are not to be construed as limiting the breadth of the present invention. Modifications, and other alternative constructions, will be apparent which are within the spirit and scope of the invention as defined in the appended claims.

What we claim is:

1. A method of manufacturing weatherstripping, including the steps of:

tufting synthetic yarn into a primary backing to form a row of tufts on one side of the primary backing and a row of tuft knuckles on the other side thereof; and contacting the tuft knuckles with a heated surface while controlling the temperature of said heated surface to deform and flatten said tuft knuckles whereby the combined thickness of said primary backing and said tuft knuckles is reduced and said tufts are more securely attached to said primary backing.

2. The method of claim 1, including supporting said one side of said primary backing on each side of said row of tufts while contacting said tuft knuckles with said heated surface.

3. The method of claim 2, wherein said supporting is effected by passing said primary backing over and in contact with a support member having an opening therein in which said row of tufts is accommodated.

4. The method of claim 3, wherein said support member is stationary and said row of tufts passes through said opening.

5. The method of claim 3, wherein said support member is a roller, and is rotating at a peripheral speed equal to the speed at which said primary backing pass over said roller.

6. The method of claim 1, wherein said heated surface is stationary.

7. The method of claim 1, wherein said heated surface is resiliently urged into contact with said knuckles.

8. The method of claim 1, wherein said heated surface is the surface of a rotating heated roller.

9. The method of claim 8, wherein there is relative motion between said heated surface and said knuckles being contacted thereby to effect a smearing action of said knuckles.

10. The method of claim 9, wherein said primary backing is moved under and past said heated roller and said heated surface is moved at a slower speed than that of said primary backing.

11. The method of claim 1, wherein said heated surface does not contact said primary backing and the flattened tuft knuckles adhere to said primary backing after cooling.

12. The method of claim 11, wherein a plurality of parallel rows of tufts are simultaneously tufted into said primary backing in spaced apart relationship, and said heated surface is grooved with said grooves being disposed above said primary backing between rows of tuft knuckles associated with said rows of tufts.

13. The method of claim 12, wherein said heated surface is rotated in contact with said tuft knuckles during said contacting step and said primary backing passes through an arc during said contacting step.

14. The method of claim 1, wherein said yarn is thermoplastic and said temperature is at least equal to the melting point of the thermoplastic yarn.

15. The method of claim 1, wherein the material of said yarn is thermoplastic, said temperature is less than the melting point of the thermoplastic yarn, there is relative movement between said knuckles and said heated surface during said contacting step, and said heated surface smears said knuckles onto said primary backing.

16. The method of claim 15, wherein tension is applied to said primary backing in a direction transverse to the direction of said relative movement during said contacting step.

17. The method of claim 1, wherein a plurality of rows of tufts are simultaneously tufted into said primary backing in spaced apart relationship, and further comprising the steps of adhering a secondary backing to said primary backing over the deformed and flattened tuft knuckles, and cutting the adhered primary and secondary backings into strips each comprising at least one of said rows of tufts.

18. Apparatus for producing weatherstripping, comprising:

a tufter for tufting a row of tufts into a primary backing fabric to form a row of pile fiber on one side of the primary backing fabric and a row of tuft knuckles on the other side thereof;

a heated member located downstream of said tufter and having a heated surface disposed to contact said tuft knuckles;

means for conveying said primary backing fabric from said tufter and past said heated member; and means for controlling the temperature of said heated surface, whereby said tuft knuckles are deformed and flattened by said heated surface.

19. The apparatus of claim 18, further comprising a support member having a groove therein, said support member being disposed opposite said heated member for said primary backing to pass therebetween, said primary backing being supported on each side of said row of pile fiber by said support member and said row of pile fiber being accommodated in said groove as said primary backing passes between said heated member and said support member.

20. Weatherstripping, comprising:

a row of tufts tufted into a strip of primary backing fabric and forming a row of pile fiber extending from one side of said strip and a row of tuft knuckles on the other side of said strip; and said tuft knuckles being deformed and flattened into a ribbon adhering to said primary backing fabric.

* * * * *